US007563216B1

(12) United States Patent
Kest

(10) Patent No.: US 7,563,216 B1
(45) Date of Patent: Jul. 21, 2009

(54) PUSH-UP EXERCISE DEVICE

(75) Inventor: Anthony Kest, Pacific Palisades, CA (US)

(73) Assignee: Bodipro Technologies, Inc., Fremont, CA (US)

( * ) Notice: Subject to any disclaimer, the term of this patent is extended or adjusted under 35 U.S.C. 154(b) by 0 days.

(21) Appl. No.: 12/209,960

(22) Filed: Sep. 12, 2008

(51) Int. Cl.
*A63B 71/00* (2006.01)

(52) U.S. Cl. ..... 482/141; 482/62; 482/140

(58) Field of Classification Search ..... 482/141, 482/62, 132, 148, 140
See application file for complete search history.

(56) References Cited

U.S. PATENT DOCUMENTS

| | | | | | |
|---|---|---|---|---|---|
| 2,253,996 | A | * | 8/1941 | Bechman | 482/146 |
| 2,950,120 | A | * | 8/1960 | Stewart | 482/51 |
| 3,416,792 | A | * | 12/1968 | Morgan et al. | 482/146 |
| 3,475,020 | A | * | 10/1969 | Schauerte | 482/146 |
| 3,862,768 | A | * | 1/1975 | England | 280/205 |
| 3,967,820 | A | * | 7/1976 | Harper | 482/146 |
| 4,111,417 | A | | 9/1978 | Gardner | |
| 4,171,805 | A | | 10/1979 | Abbott | |
| 4,463,946 | A | * | 8/1984 | Wallace et al. | 482/8 |
| 4,759,542 | A | * | 7/1988 | Hudec | 482/34 |
| 4,805,673 | A | | 2/1989 | Walthert | |
| 4,888,875 | A | | 12/1989 | Strother | |
| 5,092,586 | A | * | 3/1992 | Tuthill et al. | 482/23 |
| 5,125,880 | A | * | 6/1992 | Peters | 482/68 |
| 5,330,399 | A | * | 7/1994 | Fan | 482/34 |
| 5,397,121 | A | | 3/1995 | Gipson | |
| 5,496,248 | A | * | 3/1996 | Batscher | 482/146 |
| 5,503,101 | A | | 4/1996 | Mullinix | |
| 5,605,526 | A | | 2/1997 | Hatfield | |
| 5,895,363 | A | | 4/1999 | Quirinus | |
| 5,897,474 | A | * | 4/1999 | Romero | 482/146 |
| 5,910,074 | A | | 6/1999 | Purdie | |
| 6,551,225 | B1 | * | 4/2003 | Romero | 482/146 |
| 6,872,175 | B2 | * | 3/2005 | Lin | 482/146 |
| 2003/0100415 | A1 | | 5/2003 | Augustine | |
| 2005/0148448 | A1 | | 7/2005 | Mersch | |
| 2005/0227836 | A1 | * | 10/2005 | Wen | 482/141 |
| 2007/0270296 | A1 | | 11/2007 | Caldicott | |

* cited by examiner

*Primary Examiner*—Lori Amerson
(74) *Attorney, Agent, or Firm*—Marc E. Hankin; Kevin E. Schraven; Hankin Patent Law, APC

(57) ABSTRACT

Various embodiments of this invention disclose a push-up exercise device with a rocker, a balance indicator, and a hinged balance roller.

15 Claims, 6 Drawing Sheets

PUSH-UP EXERCISE DEVICE

BACKGROUND OF THE INVENTION

This invention generally relates to exercise devices. Specifically, it pertains to a push-up exercise device with a rocker, a balance indicator, and a hinged balance roller.

Exercise devices are an important part of many workouts because they offer different options and different challenges to what can become routine or easy exercises. Push-up exercise devices typically offer a set of handles, either joined or laid out separately, that the user places on the floor or other object adjacent to the floor. The user is then required to use his or her chest muscles and triceps to push away from the handles. The user then lowers his or her body back to the floor and repeats the first step. Most push-up exercise devices are purposefully made to be as stable as possible for two reasons: first, the more stable the push-up exercise device, the easier the exercise is; and second, the more stable the push-up exercise device, the safer the device is. Unfortunately, many of these push-up exercise devices become boring or unchallenging as the user becomes more proficient at push-ups.

When the human body has to stabilize or balance itself during movements, such as push-ups, the stomach and lower back muscles are activated. The stomach and lower back muscles are called the core or core muscles of the body. When the core muscles are used during exercise, more energy is required to perform the exercise or movement. The more energy used, the more a body's metabolic rate increases. This, in turn, results in increased lean muscle tissue development and increased fat burning. Additionally, coordination and balance are developed. There is a need in the art for a push-up exercise device that is both stable, safe, fun to use, and can offer varying challenge levels by decreasing the stability of the device and requiring the user to exercise the core muscles during the exercise.

In the area of push-up exercise devices, many types are currently available. One such push-up exercise device is disclosed by (USPN) U.S. Pat. No. 5,897,474, to Romero, which discloses an exercise device that requires the user to balance his or her body as the push-up is performed. However, among other deficiencies, the Romero exercise device is always unstable and thus, does not offer varying challenge levels.

Another push-up exercise device is disclosed by U.S. Pat. No. 5,910,074, to Purdie, which discloses a variable handle push-up device. Although the varying handles of the Purdie push-up exercise device allow the varying types of push-ups to be performed, the device itself does not vary from stable to unstable. Thus, it does not provide the balance challenge that is sought by exercisers.

Thus, there remains a long felt need in the art for a push-up exercise device that is stable, safe, fun to use, and can offer varying challenge levels by decreasing the stability of the device.

BRIEF SUMMARY OF THE INVENTION

To minimize the limitations in the prior art, and to minimize other limitations that will become apparent upon reading and understanding the present specification, the present invention discloses a push-up exercise device with a rocker, a balance indicator, and a hinged balance roller.

One embodiment of this invention is a push-up exercise device, comprising: one or more body portions and one or more balance rollers. The balance rollers have a retracted position and an extended position. When in the extended position, the balance rollers act as a fulcrum on which one can balance the push-up exercise device and one's body. The push-up exercise device may further comprise one or more balance roller hinges. It is through the balance roller hinges that the balance rollers shift from the retracted position to the extended position and vice versa. The push-up exercise device may also have one or more balance indicators and a face plate. The balance indicators are between the face plate and the top of the body portions. The body portions are curved upward so that the push-up exercise device rocks from side to side. To keep the push-up exercise device from rocking too much, there are one or more bumpers that impede rocking. To keep the push-up exercise device from slipping on the surface that it is used on, there are one or more friction rails. The push-up exercise device may also have handles and hand grips.

Another embodiment of the invention is a push-up exercise device, comprising one or more body portions that are curved upward so that the push-up exercise device rocks from side to side. To keep the push-up exercise device from rocking too much, there are one or more bumpers that impede rocking of the push-up exercise device. The push-up exercise device may also have one or more balance rollers, wherein the balance rollers have a retracted position and an extended position. The balance rollers act as a fulcrum to be balanced on when in the extended position. The push-up exercise device may further comprise one or more balance roller hinges, which allows the balance rollers to shift from the retracted position to the extended position and vice versa. The push-up exercise device further comprises one or more balance indicators and a face plate. The balance indicators are between the face plate and the top of the body portions. The push-up exercise device may also comprise of one or more friction rails to provide increased friction between the exercise surface and the push-up exercise device. The push-up exercise device may also have handles and handgrips.

Another embodiment of the invention is a method of performing an exercise movement, the steps comprising: shifting one or more balance rollers of a push-up exercise device from a retracted position to an extended position; setting the push-up exercise device on a surface such that the balance rollers contact the surface; positioning a body over the push-up exercise device so that an upper portion of the body is above the push-up exercise device, and a lower portion of the body extends distally away from the push-up exercise device; grasping the push-up exercise device with one or more hands of the body; balancing the push-up exercise device on the balance rollers so that only the balance rollers are in contact with the surface, and all other parts of the push-up exercise device are not in contact with the surface; lowering the upper portion of the body towards the push-up exercise device and simultaneously maintaining a balance of the push-up exercise device; and raising the upper portion of the body away from the push-up exercise device and simultaneously maintaining the balance of the push-up exercise device. The method may further comprise the steps of using one or more senses of the body to determine if the balance of the push-up exercise device is maintained, and repeating the lowering and the raising steps until a desired number of repetitions is complete.

An object of the present invention is to provide a push-up exercise device that will overcome the deficiencies of the prior art.

Another object of the present invention is to provide a push-up exercise device that will allow the user to vary the skill and athletic ability needed to accomplish a set of push-ups or other exercise movements.

Another object of the present invention is to provide a push-up exercise device that is safe and fun to use.

Another object of the present invention is to provide a durable push-up exercise device that may be used by a wide variety of people regardless of their body size or workout ability.

Another object of the present invention is to provide an inexpensive, lightweight, and portable push-up exercise device.

Another object of this invention is to provide a push-up exercise device that informs the user of when they are properly balanced when performing a push-up or other exercise movement.

Other features and advantages are inherent in the push-up exercise device claimed and disclosed will become apparent to those skilled in the art from the following detailed description and its accompanying drawings.

DETAILED DESCRIPTIONS OF THE DRAWINGS

In the following detailed description of the preferred embodiment, reference is made to the accompanying drawings that form a part hereof, and in which is shown, by way of illustration, a specific embodiment in which the invention may be practiced. It is to be understood that other embodiments may be utilized and structural changes may be made without departing from the scope of the present invention.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

Figure 1:
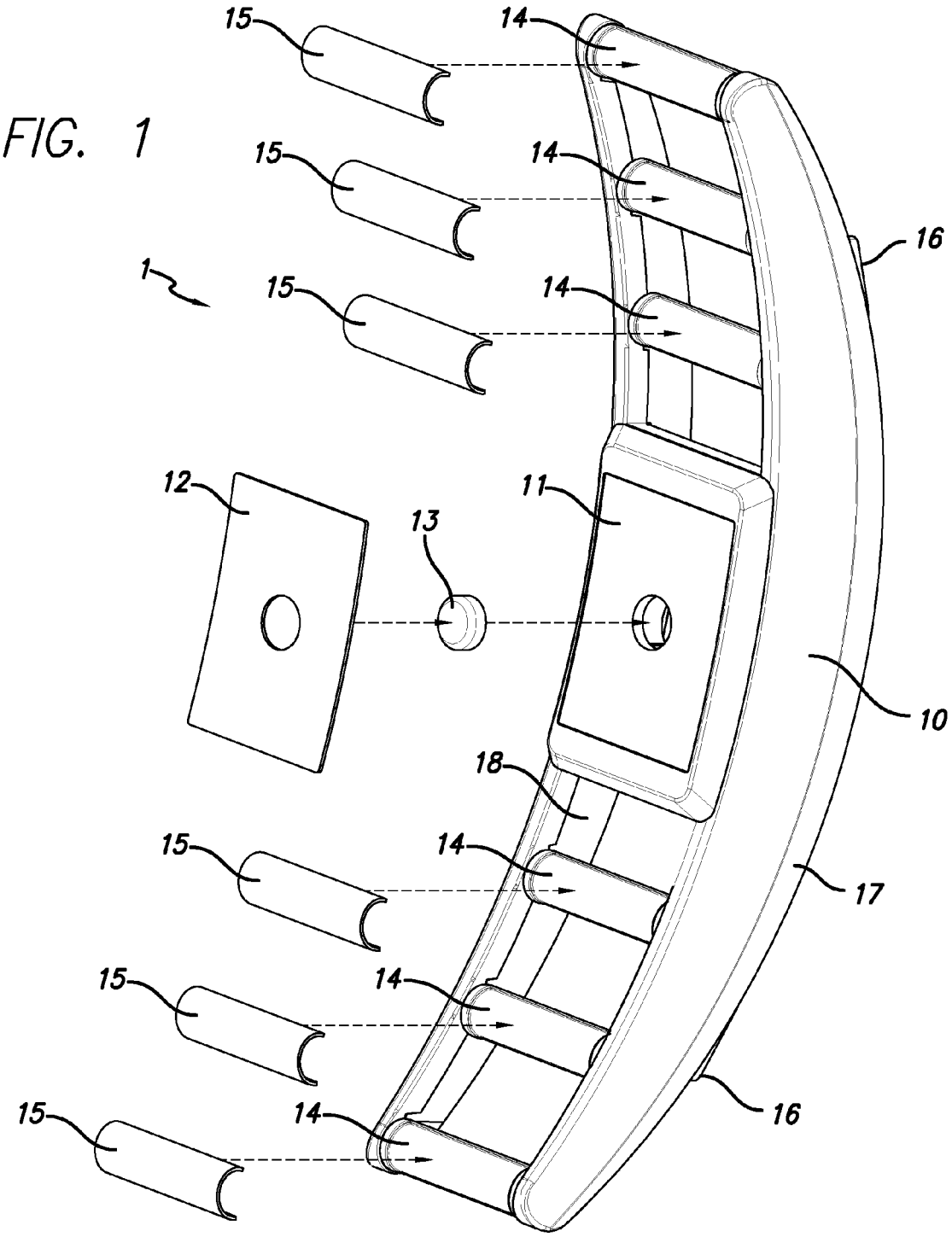
FIG. 1 is an illustration of a top and front exploded perspective view of one embodiment of the push-up exercise device.

FIG. 1 is an illustration of a top and front exploded perspective view of one embodiment of the push-up exercise device. FIG. 1 shows push-up exercise device 1 with a body 10, top face pad 11, face plate 12, balance indicator 13, handles 14, hand grips 15, front bumpers 16, front body rail 17, and back body rail 18. As shown in FIG. 1, push-up exercise device 1 is preferably curved upward from a center point on the bottom of front body rail 17 and back body rail 18. This curvature allows the user to experience a side to side rocking motion when push-up exercise device 1 is used to perform push-ups. Although FIG. 1 shows push-up exercise device 1 as curved upward, push-up exercise device 1 may be flat, convex, or any geometric or irregular shape without deviating from the scope of this invention.

Push-up exercise device 1 is preferably constructed from as few separate parts as possible. As shown in FIG. 1, push-up exercise device 1, is made from several separate parts, including six hand grips 15, face plate 12, balance indicator 13, and body 10. As shown in FIG. 1, body 10 includes the sub-parts handles 14, front bumpers 16, front body rail 17, and back body rail 18. The sub-parts of body 10 are preferably made from a single piece of molded material, such as plastic, such that no sub-part is detachable. Alternatively, push-up exercise device 1 can be made from as few as one part, to as many as several thousand parts without deviating from the scope of the invention.

Push-up exercise device 1 is preferably made out of high impact plastic, but can be made from any natural or synthetic material, including, but not limited to: metal; metal alloy; wood or other fibrous plant product such as hemp, paper, or cardboard; glass; composite materials such as graphite, fiberglass, boron, or Kevlar; admixtures of plastic resins combined with metal, metal alloy, wood or other fibrous plant product, glass, or composite materials; plastic; animal materials such as wool, bone, or hardened leather; or any combination of these materials, without departing from the scope of the present invention. Further, hand grips 15 are preferably made out of plastic foam, but can be made from any material, including those materials listed immediately above.

Although FIG. 1 shows push-up exercise device 1 with 6 hand grips 15, hand grips 15 may be absent or, alternatively, hand grips 15 may be incorporated into and not detachable from handles 14. Preferably, hand grips 15 are glued or bonded onto handles 14, but hand grips 15 may be connected to handles 14 in any manner, including, but not limited to: straps, zip-ties, chains, clips, binders, bungees, cords, ropes, strings, cables, fasteners, staples, hook and loop, friction, bands, latches, stitches, snaps, wenches, glue, other natural or synthetic chemical adhesives, adhesive tape, heat bonding, chemical bonding, crimps, clamps, or ultrasonic welding.

As shown in FIG. 1, push-up exercise device 1 is preferably symmetrical such that front body rail 17 and back body rail 18 are identical mirror images of each other. Additionally, the left side and right side of push-up exercise device 1 are preferably identical mirror images of each other. A symmetrical design is preferred so that the user obtains a balanced and symmetrical workout. Other embodiments of push-up exercise device 1 may be asymmetrical in front to back, side to side, or both configurations, without deviating from the scope of the invention.

FIG. 1, as preferred, shows push-up exercise device 1 with six handles 14 and six hand grips 15. This configuration allows the user to vary the engagement point for push-up exercise device 1 and thus, vary the exercise routine. This design is preferred because it allows the user to vary which muscles are exercised. There can be as few as zero handles and as many as several thousand handles without deviating from the scope of the invention. As shown in FIG. 1, handles 14, as preferred, are arrayed in parallel, relative to each other, and perpendicular, relative to front body rail 17 and back body rail 18. However, handles 14 may be presented in any array with respect to each other and with respect to front body rail 17 and back body rail 18. For example, the handles that are on the outer or distal positions may be parallel to front body rail 17 and back body rail 18, and, at the same time, the handles in the inner or proximal positions may be presented at, for example, a 45 degree angle with respect to front body rail 17 and back body rail 18. Indeed, handles 14 may be presented in any combination of angles, arrays, and positions without deviating from the scope of this invention.

FIG. 1 also shows that push-up exercise device 1 preferably includes one balance indicator 13. However, push-up exercise device 1 may have as few as zero and as many as several thousand balance indicators without deviating from the scope of the invention. As shown in FIG. 1, balance indicator 13 is preferably placed in a notch in the center of top face pad 11 with face plate 12 placed on top of both top face pad 11 and balance indicator 13. In this configuration, balance indicator 13 is securely fixed into, and protected, by top face pad 11 and face plate 12. Because balance indicator 13 is placed in the center of top face pad 11, it is easily viewed, heard, or otherwise sensed by the user as the push-ups or other exercises are performed. Additionally, balance indicator 13 should be placed in the center so that it is directly above the balance roller (discussed below). This way balance indicator 13 will provide the most accurate balance information to the user. Alternatively, balance indicator 13 may be placed on any part of push-up exercise device 1 and may be placed in any position on push-up exercise device 1, so long as balance indicator 13 gives the user useful balance information. Balance indicator 13 is preferably connected to push-up exercise device 1 via friction, but it may be connected using any means, including, but not limited to: nails, screws, friction, straps, zip-ties, chains, clips, binders, bungees, cords, ropes, strings, cables, fasteners, staples, hook and loop, bands, latches, stitches, snaps, wenches, glue, other natural or synthetic chemical adhesives, adhesive tape, heat bonding, chemical bonding, crimps, clamps, or ultrasonic welding.

The user of push-up exercise device 1 performs push-ups and other exercise movements while attempting to maintain the balance of push-up exercise device 1. Balance indicator 13 is a useful guide that informs the user when the push-up, or other exercise movement, is being completed in a balanced manner. Balance indicator 13 is preferably a standard bubble level balance indicator that is well known in the art, but it may be any type of balance indicator, including, but not limited to: audible, vibratory, or other visual balance indicators. Additionally, balance indicator 13 may also be electronic or digital without deviating from the scope of the invention.

As shown in FIG. 1, front body rail 17 preferably has front bumpers 16 along the curvature of front body rail 17. Front bumpers 16 act as an inhibitor to the side to side rocking motion that the user may experience when doing a push-up with push-up exercise device 1. Front bumpers 16 are important to impede a user from rocking in an uncontrolled and unsafe manner. Front bumpers 16 are not designed to completely stop the rocking motion, but merely to act as an impediment to rocking too far to either side and to let the user know that the rocking may be outside the safe zone. Front bumpers 16 essentially prevent push-up exercise device 1 from completing, in an even and smooth manner, a rocking motion that goes all the way to the ends of push-up exercise device 1. As shown in FIG. 1, front bumpers 16 are preferably located over half way up the curvature of front body rail 17. Additionally, FIG. 1 shows that front rail 17 preferably has two front bumpers 16, a right bumper and a left bumper, that are at equal, mirror image positions, relative to each other, along front rail 17. This configuration provides an equal side to side rocking impediment. Although FIG. 1 shows a preferred number of front bumpers 16, and placement of front bumpers 16, there may be as few as zero bumpers and as many as several thousand bumpers. Further, front bumpers 16 may be unevenly or asymmetrically spaced along front rail 17 without deviating from the scope of this invention.

Figure 2:
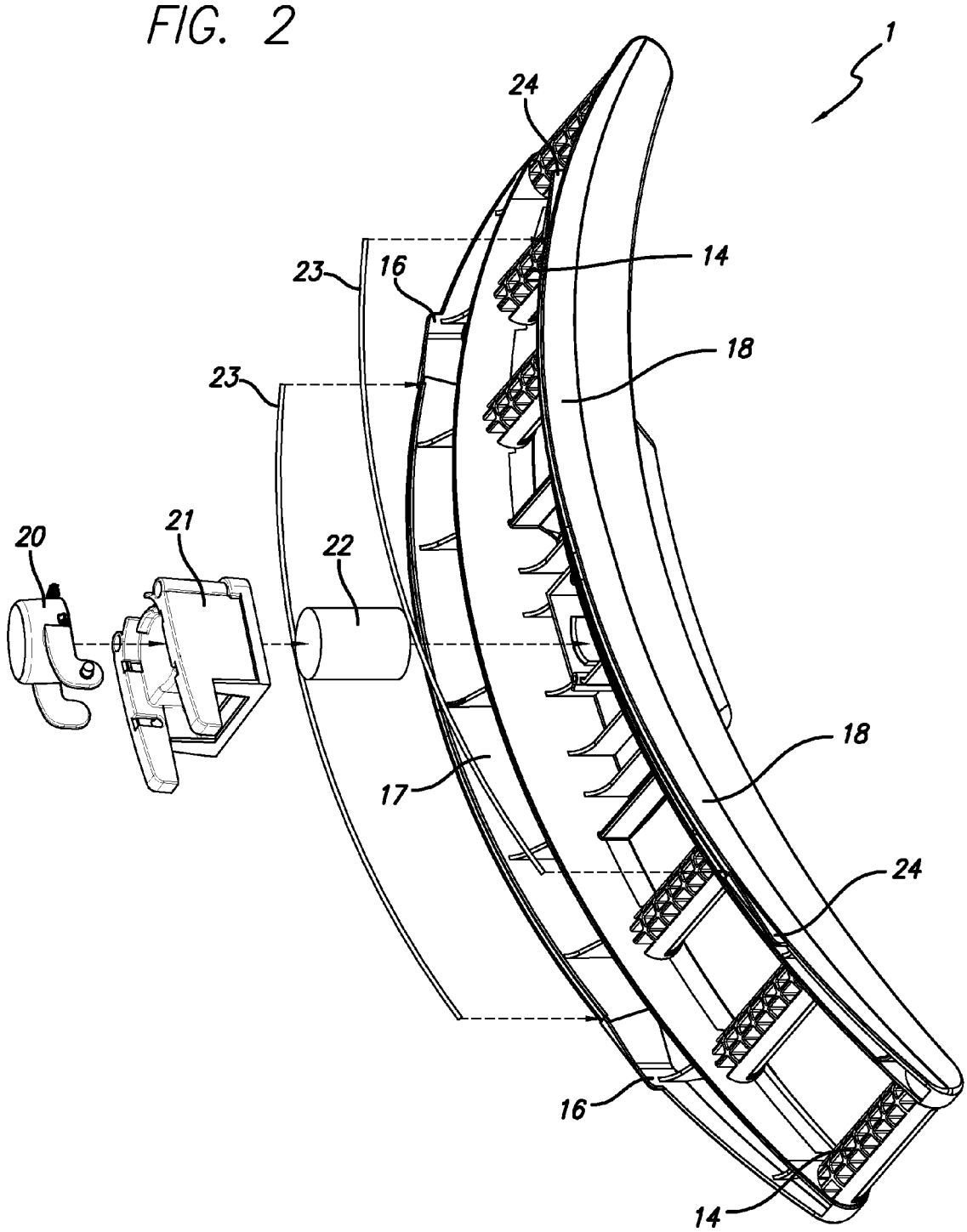
FIG. 2 is an illustration of a bottom and back exploded perspective view of one embodiment of the push-up exercise device.

FIG. 2 is an illustration of a bottom and back exploded perspective view of one embodiment of the push-up exercise device. As shown in FIG. 2, push-up exercise device 1 has handles 14, front bumpers 16, front body rail 17, back body rail 18, balance roller 20, housing 21, peg 22, friction rails 23, and back bumpers 24. FIG. 2 shows how peg 22 is preferably connected to the bottom of push-up exercise device 1 and acts as a stable base for balance roller 20. Housing 21 is preferably connected to and around peg 22 and balance roller 20 is then connected to housing 21. In this configuration, the roller end of balance roller 20 extends below the bottoms of front body rail 17 and back body rail 18 when balance roller 20 is engaged. Thus, when push-up exercise device 1 is placed on the floor, bottom side down, balance roller 20 engages with the floor, or other surface, before front body rail 17 or back body rail 18 touch the floor. Although FIG. 2 shows that push-up exercise device 1 is made from a plurality of separate parts, such as peg 22, balance roller 20, and housing 21, push-up exercise device 1 can be made, as discussed above, from as few as one part or as many as several thousand parts without deviating from the scope of the invention. Push-up exercise device 1 preferably has one balance roller 20, but some embodiments may have no balance rollers or thousands of balance rollers.

FIG. 2 also shows push-up exercise device 1, as preferred, with friction rails 23. Friction rails 23 are preferably made out of a high friction material, such as rubber, that will provide an anti-slip property to push-up exercise device 1. This design prevents the push-up exercise device from slipping if it is used on a slick surface. Friction rails 23 can be made from any natural or synthetic material, including, but not limited to: metal; metal alloy; wood or other fibrous plant product such as hemp, paper, or cardboard; glass; composite materials such as graphite, fiberglass, boron, or Kevlar; admixtures of plastic resins combined with metal, metal alloy, wood or other fibrous plant product, glass, or composite materials; plastic animal materials such as wool, bone, or hardened leather; or any combination of these materials, without departing from the scope of the present invention. Finally, although FIG. 2 shows friction rails 23 as a separate part, friction rails 23 may be absent or completely integrated into push-up exercise device 1 without deviating from the scope of the invention.

Figure 3:
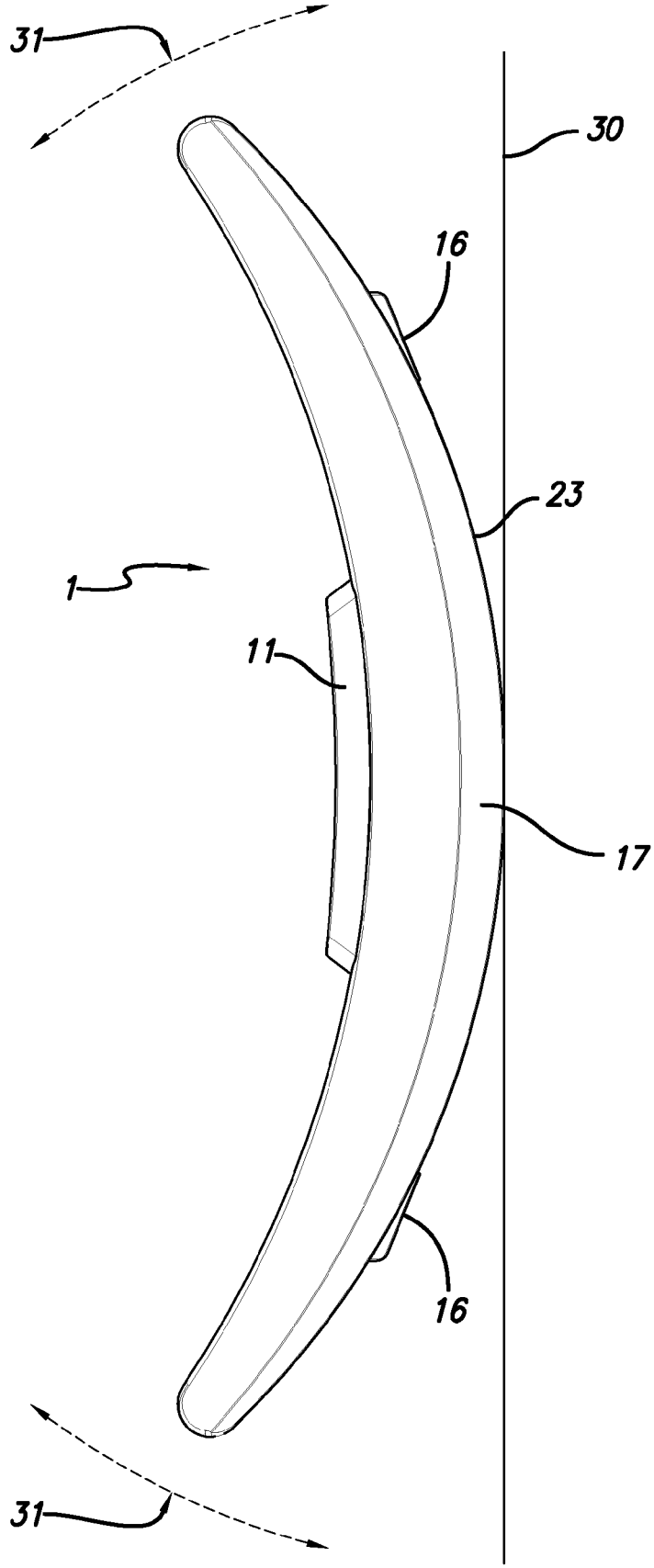
FIG. 3 is an illustration of a front view of one embodiment of the push-up exercise device.

FIG. 3 is an illustration of a front view of one embodiment of the push-up exercise device. As shown in FIG. 3, push-up exercise device 1 rests on surface 30 and has top face pad 11, front bumpers 16, front body rail 17, and friction rail 23. Front body rail 17 and back body rail 18 (not visible in FIG. 3), in this embodiment, are in direct contact with surface 30. Front body rail 17 and back body rail 18 provide an unstable and rocking base for push-up exercise device 1. Broken line double headed arrows 31 in FIG. 3, show how push-up exercise device 1 may rock from side to side depending up on how much force is applied to the left and right ends of push-up exercise device 1. As push-up exercise device 1 rocks from side to side, the contact point between surface 30 and front body rail 17 and back body rail 18 shifts from side to side. This type of rocking motion allows the user to experience a more difficult push-up that exercises the core and balance muscles of the body.

FIG. 3 also shows how front bumpers 16 will act as an impediment to the rocking motion if the side to side rocking is great enough to cause front bumpers 16 to come into contact with surface 30. Finally, FIG. 3 shows how friction rail 23 is connected to front body rail 18 and how friction rail 23 is preferably in direct contact with surface 30.

Figure 4:
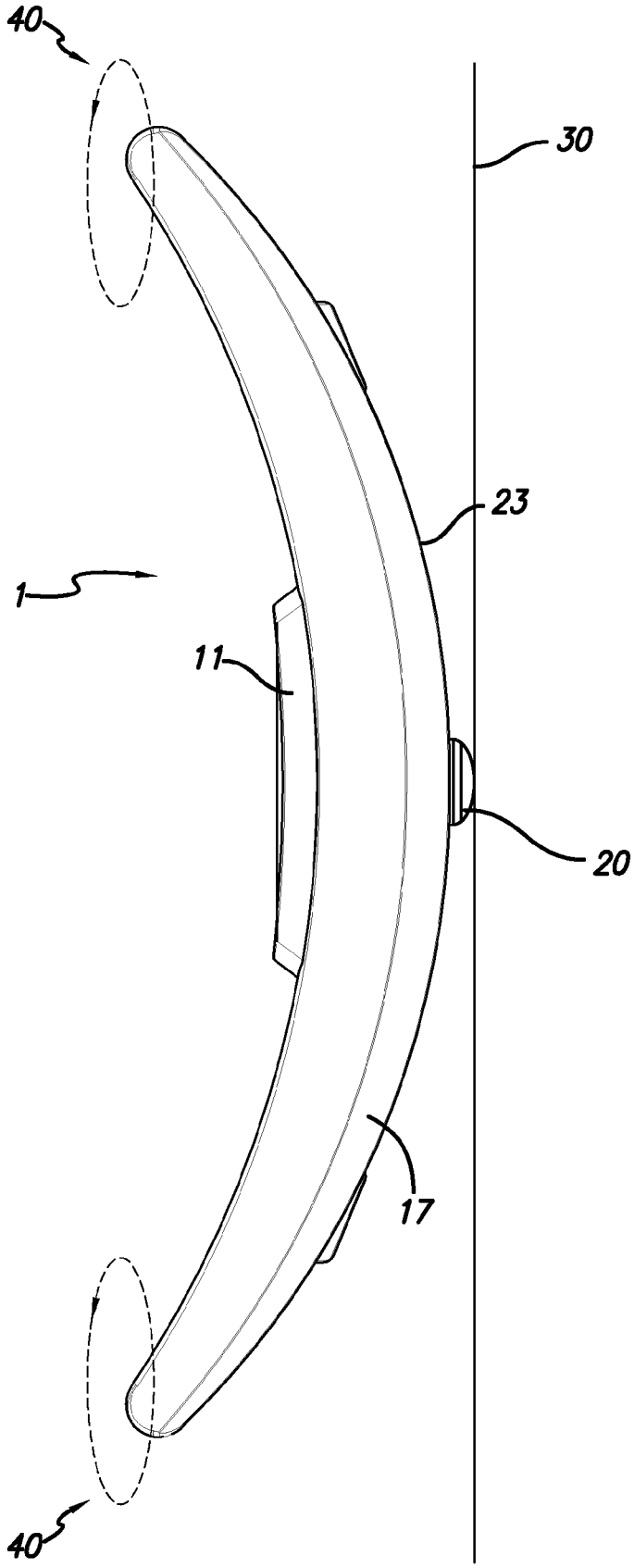
FIG. 4 is an illustration of a front view of one embodiment of the push-up exercise device with the balance roller extended.

FIG. 4 is an illustration of a front view of one embodiment of the push-up exercise device with the balance roller extended. As shown in FIG. 4, push-up exercise device 1 has top face pad 11, front body rail 17 and balance roller 20. In this embodiment, balance roller 20 is in an extended position and thus projects below the bottom of front body rail 17 and back body rail 18 (not visible in FIG. 4). Balance roller 20 is in direct contact with surface 30 and balance roller 20 is the fulcrum of push-up exercise device 1. This design of push-up exercise device 1 allows the user to experience a more difficult push-up or other exercise movement. The user must balance push-up exercise device 1 on balance roller 20 and, while maintaining balance, complete the push-up or exercise movement. When push-up exercise device 1 is balanced on balance roller 20 it may rock or roll in any and every direction. The broken line arrows 40, in FIG. 4, show how push-up exercise device 1 may rock or roll in any direction.

The surface of balance roller 20 is preferably made out of a high friction material, such as rubber or high density foam. This will provide an anti-slip property to push-up exercise device 1. This design prevents push-up exercise device 1 from slipping if it is being used on a slick surface. The surface of balance roller 20 can be made from any natural or synthetic material, including, but not limited to: metal; metal alloy; wood or other fibrous plant product such as hemp, paper, or cardboard; glass; composite materials such as graphite, fiberglass, boron, or Kevlar; admixtures of plastic resins combined with metal, metal alloy, wood or other fibrous plant product, glass, or composite material; plastic; animal materials such as wool, bone, or hardened leather; or any combination of these materials, without departing from the scope of the present invention.

As shown in FIG. 4, balance roller 20, when in an extended position, is preferably in the center of push-up exercise device 1. When balance roller 20 is in an extended position, balance indicator 13 (not shown in FIG. 4) is preferably in the center of top face pad 11 and directly above balance roller 20. With this design, the user is able to accurately gage if he or she is in balance as the push-up or other exercise movement is completed.

FIG. 4 shows that the bottom of balance roller 20 is preferably a half-sphere, so that when balance roller 20 comes into contact with surface 30 the user is able to smoothly maintain balance by rocking and rolling push-up exercise device 1 into a balance position. However, balance roller 20 may be any geometric or irregular shape without deviating from the scope of the invention, as shown in FIG. 2.

Figure 5:
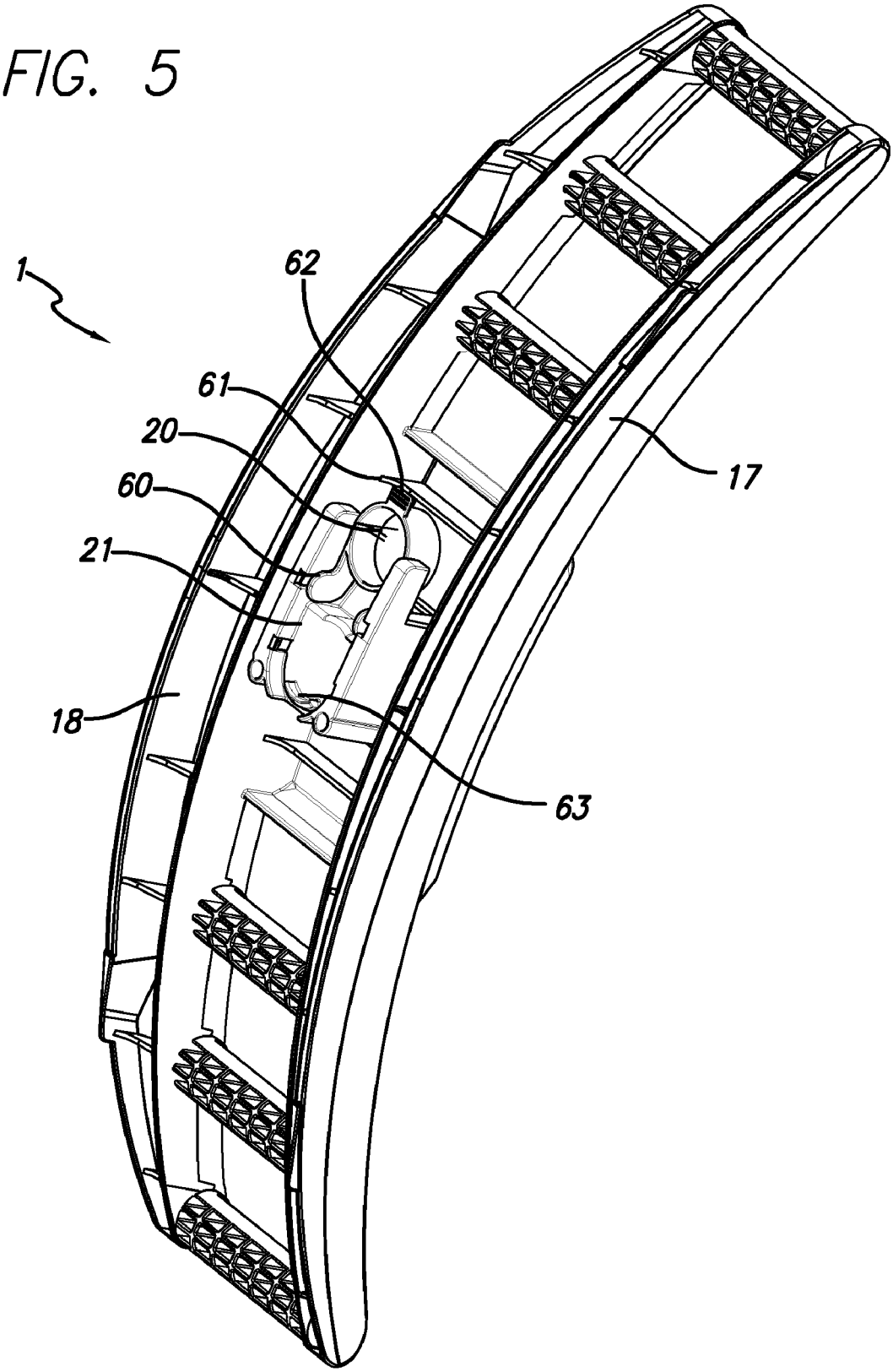
FIG. 5 is an illustration of a bottom and front perspective view of one embodiment of the push-up exercise device with the balance roller retracted.

FIG. 5 is an illustration of a bottom and front perspective view of one embodiment of the push-up exercise device with the balance roller retracted. As shown in FIG. 5 push-up exercise device 1 has front body rail 17, back body rail 18, housing 21, balance roller 20, housing hinge 60, roller friction snap holder 61, balance roller tab 62, and housing friction snap holder 63. FIG. 5 shows balance roller 20 in a retracted position between front body rail 17 and back body rail 18. In this position, balance roller 20 does not project lower than front body rail 17 or back body rail 18 and thus does not contact the surface on which push-up exercise device 1 is placed. In the retraced position, balance roller 20 is preferably recessed deep enough into the bottom of push-up exercise device 1 such that it does not interfere with the side to side rocking motion as detailed by FIG. 4.

FIG. 5 shows that balance roller 20 is preferably attached to housing 21 at housing hinge 60. As shown in FIG. 5, balance roller 20 is attached to housing 21 via a simple friction snap hinge mechanism of any number of such types that are well known. This design allows balance roller 20 to be recessed, half-sphere side up, into the bottom of push-up exercise device 1. Balance roller 20 is recessed when the user does not want to engage balance roller 20 during the workout. This design also allows balance roller 20 to be completely disengaged from housing 21 for easy replacement or cleaning.

Balance roller 20, as shown in FIG. 5, is held in the retracted position by roller friction snap holder 61. When the user wants to engage balance roller 20, he or she pulls outward or downward on balance roller tab 62, pivots balance roller 20 at housing hinge 60, and then snaps balance roller 20 into an extended position by engaging balance roller 20 with housing friction snap holder 63. Although FIG. 5 shows that balance roller 20 is preferably attached to housing 21 through a simple friction snap hinge mechanism, balance roller 20 may be attached to housing 21 through any means including, but not limited to: nails, screws, friction, straps, zip-ties, chains, clips, binders, bungees, cords, ropes, strings, cables, fasteners, staples, hook and loop, bands, latches, stitches, snaps, wenches, glue, other natural or synthetic chemical adhesives, adhesive tape, heat bonding, chemical bonding, crimps, clamps, or ultrasonic welding. Moreover, housing 21 and balance roller 20, as discussed above, may be a single part. If housing 21 and balance roller 20 are a single part and thus, not separable, they may still hinge via a living hinge mechanism. Finally, balance roller 20 may be held securely in the retracted or extended positions by any means including: nails, screws, friction, straps, zip-ties, chains, clips, binders, bungees, cords, ropes, strings, cables, fasteners, staples, hook and loop, bands, latches, stitches, snaps, wenches, glue, other natural or synthetic chemical adhesives, adhesive tape, heat bonding, chemical bonding, crimps, clamps, or ultrasonic welding.

Figure 6:
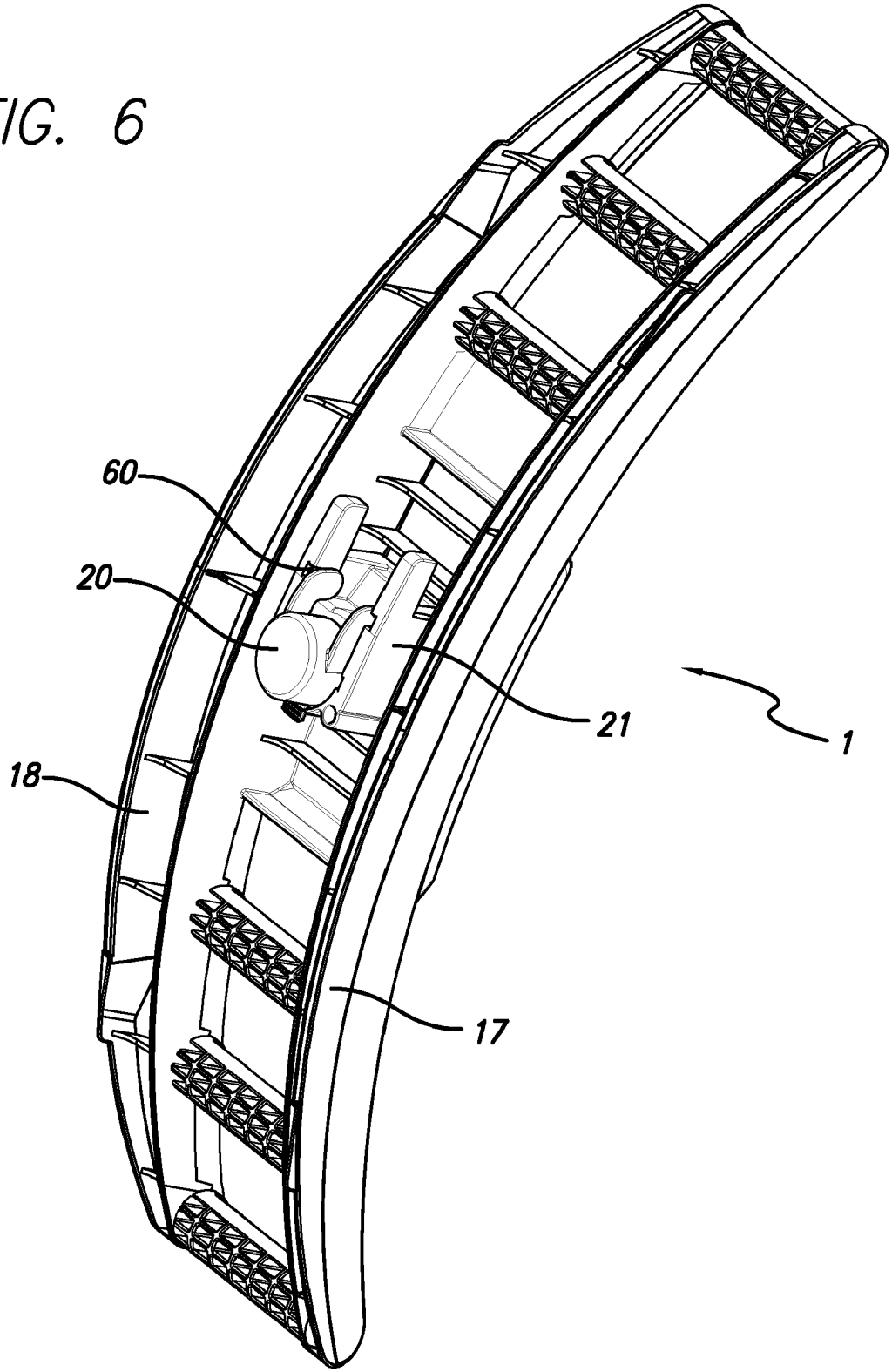
FIG. 6 is an illustration of a bottom and front perspective view of one embodiment of the push-up exercise device with the balance roller extended.

FIG. 6 is an illustration of a bottom and front perspective view of one embodiment of the push-up exercise device with the balance roller extended. As shown in FIG. 6, balance roller 20 has been pivoted at housing hinge 60 such that balance roller 20 projects lower than the bottom of front body rail 17 and back body rail 18. In this position, when push-up exercise device 1 is placed on a surface, balance roller 20 comes into direct contact with the surface. The user then performs push-ups or other exercise movements while balancing on balance roller 20.

As shown in FIG. 6, housing 21 preferably holds balance roller 20 in place in the extended position so that balance roller 20 is in the center of push-up exercise device 1. As discussed above, balance roller 20 may be off center or in any other position without deviating from the scope of this invention.

In summary, the present invention is a push-up exercise device with a rocker, a balance indicator, and a hinged balance roller.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. A method of performing an exercise movement, the steps comprising:

providing a push-up exercise device, wherein said push-up exercise device is comprised of a body portion, a balance roller, a balance roller hinge, a balance indicator, a face plate, a roller friction snap holder, a housing friction snap holder, a balance roller tab, one or more handles, one or more hand grips, one or more bumpers, and one or more friction rails; wherein said body portion comprises a front body rail and a back body rail; wherein said front body rail and said back body rail are on a bottom of said body portion; wherein said front body rail and said back body rail are curved upward from a middle of said front and back body rails; wherein said balance roller has an outer surface; wherein said outer surface is static; wherein said balance indicator is between said face plate and a top of said body portion; wherein said balance roller pivots on said balance roller hinge from a retracted position to an extended position; wherein said extended balance roller projects beyond said bottom of said body portion; wherein said roller friction snap holder holds said balance roller in said retracted position; and wherein said housing friction snap holder holds said balance roller in said extended position;

shifting said balance rollers of said push-up exercise device from said retracted position to said extended position;

setting said push-up exercise device on a surface wherein said balance roller contacts said surface;

positioning a body over said push-up exercise device; wherein an upper portion of said body is above said push-up exercise device, and a lower portion of said body extends distally away from said push-up exercise device;

grasping said push-up exercise device with one or more hands of said body;

balancing said push-up exercise device on said one or more balance rollers, wherein said push-up exercise device rocks in any direction; and wherein said bottom of said friction rails are not in contact with said surface;

lowering said upper portion of said body towards said push-up exercise device and simultaneously maintaining a balance of said push-up exercise device;

raising said upper portion of said body away from said push-up exercise device and simultaneously maintaining said balance of said push-up exercise device;

using one or more senses of said body to determine if said balance of said push-up exercise device is maintained; and repeating said lowering and said raising steps until a desired number of repetitions is complete.

2. A push-up exercise device, comprising:

one or more body portions;

one or more balance rollers;

one or more balance roller hinges;

one or more balance indicators;

wherein said one or more body portions comprise a front body rail and a back body rail; and wherein said front body rail and said back body rail are on a bottom of said one or more body portions;

wherein said front body rail and said back body rail are curved upward from a middle of said front and back body rails;

wherein said one or more balance rollers have an outer surface and wherein said outer surface is static;

wherein said one or more balance rollers pivot on said one or more balance roller hinges from a retracted position to an extended position;

wherein said one or more extended balance rollers project beyond said bottom of said one or more body portions;

wherein said push-up exercise device rocks in all directions on said one or more extended balance rollers;

wherein said one or more retracted balance rollers are recessed within said bottom of said front and back body rails;

wherein said push-up exercise device rocks to and from a body left side and a body right side with said one or more retracted balance rollers; and wherein said one or more balance indicators indicate a balance during rocking of said push-up exercise device.

3. The push-up exercise device of claim 2, further comprising:

a face plate;

one or more roller friction snap holders;

one or more housing friction snap holders; and one or more balance roller tabs;

wherein said one or more balance indicators are between said face plate and a top of said one or more body portions;

wherein said one or more roller friction snap holders hold said one or more balance rollers in said retracted position; and wherein said one or more housing friction snap holders hold said one or more balance rollers in said extended position.

4. The push-up exercise device of claim 3, further comprising:

one or more handles; and one or more hand grips.

5. The push-up exercise device of claim 4, further comprising:

one or more bumpers;

one or more friction rails;

wherein said one or more bumpers impede rocking of said push-up exercise device.

6. The push-up exercise device of claim 5, wherein said one or more balance rollers are half-spherical and are comprised of a material from the group consisting of rubber, high density foam, or high friction plastic.

7. The push-up exercise device of claim 6, wherein said one or more handles are perpendicular to said front and back body rails.

8. The push-up exercise device of claim 7, wherein said friction rails are comprised of a material from the group consisting of rubber, high density foam, or high friction plastic.

9. A push-up exercise device, comprising:

a body portion, a balance roller, a balance roller hinge, a balance indicator;

wherein said balance roller hinge is attached to a bottom of said body portion;

wherein said balance roller has a bottom outer surface and wherein said bottom outer surface is static;

wherein said body portion comprises a front body rail and a back body rail; and wherein said front body rail and said back body rail are on a bottom of said body portion;

wherein said front body rail and said back body rail are curved upward from a middle of said front and back body rails;

wherein said balance roller pivots on said balance roller hinge from a retracted position to an extended position;

wherein said extended balance roller projects beyond a bottom of said front and back body rails;

wherein said push-up exercise device rocks in all directions on said extended balance roller;

wherein said retracted balance roller is recessed within said bottom of said front and back body rails, wherein said push-up exercise device rocks to and from a body left side and a body right side with said retracted balance roller; and wherein said balance indicator indicates a balance during rocking of said push-up exercise device.

10. The push-up exercise device of claim 9, further comprising:

a face plate;

a roller friction snap holder;

a housing friction snap holder; and a balance roller tab;

wherein said one or more balance indicators are between said face plate and a top of said body portion;

wherein said roller friction snap holder holds said balance roller in said retracted position; and wherein said housing friction snap holder holds said balance roller in said extended position.

11. The push-up exercise device of claim 10, further comprising:

one or more handles; and one or more hand grips.

12. The push-up exercise device of claim 11, further comprising:

one or more bumpers;

one or more friction rails;

wherein said one or more bumpers impede rocking of said push-up exercise device; and wherein said one or more friction rails are on a bottom of said front body rail and a bottom of said back body rail.

13. The push-up exercise device of claim 12, wherein said balance roller is half-spherical and wherein said bottom outer surface of said balance roller is comprised of a material from the group consisting of rubber, high density foam, or high friction plastic.

14. The push-up exercise device of claim 13, wherein said one or more handles are perpendicular to said front and back body rails.

15. The push-up exercise device of claim 14, wherein said friction rails are comprised of a material from the group consisting of rubber, high density foam, or high friction plastic.

* * * * *